US005813925A

United States Patent [19]

Lewy

[11] Patent Number: 5,813,925

[45] Date of Patent: Sep. 29, 1998

[54] APPARATUS FOR PRACTICING SLIDING INTO A BASEBALL BASE AND METHOD OF USE

[76] Inventor: Winston B. Lewy, 6371 Adelaide Pl., Los Angeles, Calif. 90042

[21] Appl. No.: 852,132

[22] Filed: May 6, 1997

[51] Int. Cl.[6] ..... A63B 69/40

[52] U.S. Cl. ..... 473/430

[58] Field of Search ..... 473/422, 423, 473/424, 426, 427, 428, 429, 430, 109, 160, 213, 214

[56] References Cited

U.S. PATENT DOCUMENTS

| | | | |
|---|---|---|---|
| 3,042,401 | 7/1962 | Denegre | 473/30 |
| 3,924,855 | 12/1975 | Pretorious | 473/30 |
| 4,216,960 | 8/1980 | Nicholls | 473/30 |
| 4,521,016 | 6/1985 | Tominaga | 473/30 |
| 5,048,821 | 9/1991 | Love | 473/30 |

*Primary Examiner*—Theatrice Brown
*Attorney, Agent, or Firm*—Timothy T. Tyson; Ted Masters; Freilich, Hornbaker & Rosen

[57] ABSTRACT

An apparatus (20) for practicing sliding into a baseball base (502) includes a first baseball (22) connected by a first tether (24) to a support structure (30). The length (L) of first tether (24) is adjusted so that first baseball (22) is suspended between approximately one and six inches above the ground (500). First baseball (22) is swung in pendulum fashion, and a sliding player attempts to touch a baseball base (502) without being hit by the swinging first baseball (22). In another embodiment, a second swinging baseball (42) is added.

12 Claims, 4 Drawing Sheets

APPARATUS FOR PRACTICING SLIDING INTO A BASEBALL BASE AND METHOD OF USE

TECHNICAL FIELD

The present invention pertains to practice devices for improving the skills of baseball players, and more particularly to an apparatus for enhancing the player's base sliding ability.

BACKGROUND ART

Practice devices and apparatus for improving the skills of baseball players are well known in the art. These devices range from pitching and throwing targets to batting cages and pitching machines. Certain of these devices utilize the concept of a tethered baseball. For example, U.S. Pat. No. 3,716,235 shows a ball batting practice support structure providing high strength, durability, and adjustable features while being collapsible for shipment and storage. The support structure is adaptable to either overhead, sidewall, or combination of overhead and sidewall mounting. Telescopic support arms permit adjustment of the position of a tethered ball in relation to the overhead or sidewall. U.S. Pat. No. 4,050,694 defines a baseball batting practice kit containing a flexible ball tether swivelably suspended from a horizontal arm whose height is adjustable upon a vertical stand. The batting practice kit enables solitary batting practice by children who stand in correct relationship to the ball using a practice mat simulating a playing field surface including the shape of home plate. U.S. Pat. No. 5,106,085 depicts a baseball hitting practice apparatus for improving a user's batting form and hitting average. The device consists of a simulated home plate area together with guide markers to assist a user in achieving the correct batting stance as well as stride while practicing with the device. In one embodiment, baseballs are suspended by strings from a support structure.

It is noted that each of the aforementioned practice devices are addressed to the batting of a baseball.

DISCLOSURE OF INVENTION

The present invention is directed to an apparatus for practicing sliding into a baseball base. The apparatus is designed to help players practice base sliding without getting hurt. The apparatus allows the player to practice alone so that he/she can perfect sliding skills of getting past the base player without being tagged by the baseball. The apparatus utilizes a swinging baseball to simulate the situation of being tagged by the base player with the baseball. The present invention can be fabricated from readily available parts, is portable, is easy to assemble, and may be stored in a small space. In a preferred embodiment, the invention is made out of pipes and pipe fittings. A preferred name for the apparatus is Slide Master Deluxe.

In accordance with a preferred embodiment of the invention, an apparatus for practicing sliding into a baseball base comprises a baseball, a support structure having a connection point located a height above the ground, and a tether connecting the baseball and the connection point. The tether has a length which is approximately one to six inches less than the height, so that the baseball is suspended approximately one to six inches above the ground.

In accordance with an important feature of the invention, the baseball can be selectively swung in pendulum fashion.

In accordance with an important aspect of the invention, the support structure is fabricated from pipe and pipe fittings.

In accordance with another important feature of the invention, the height of the connection point is selectively adjustable.

In accordance with another important aspect of the invention, a baseball base is disposed on the ground near the suspended baseball.

In accordance with a feature of the invention, a weight is attached to the baseball.

In accordance with another feature of the invention, the apparatus includes a plurality of suspended baseballs.

Other features and advantages of the present invention will become apparent from the following detailed description, taken in conjunction with the accompanying drawings, which illustrate, by way of example, the principles of the invention.

MODES FOR CARRYING OUT THE INVENTION

Figure 1:
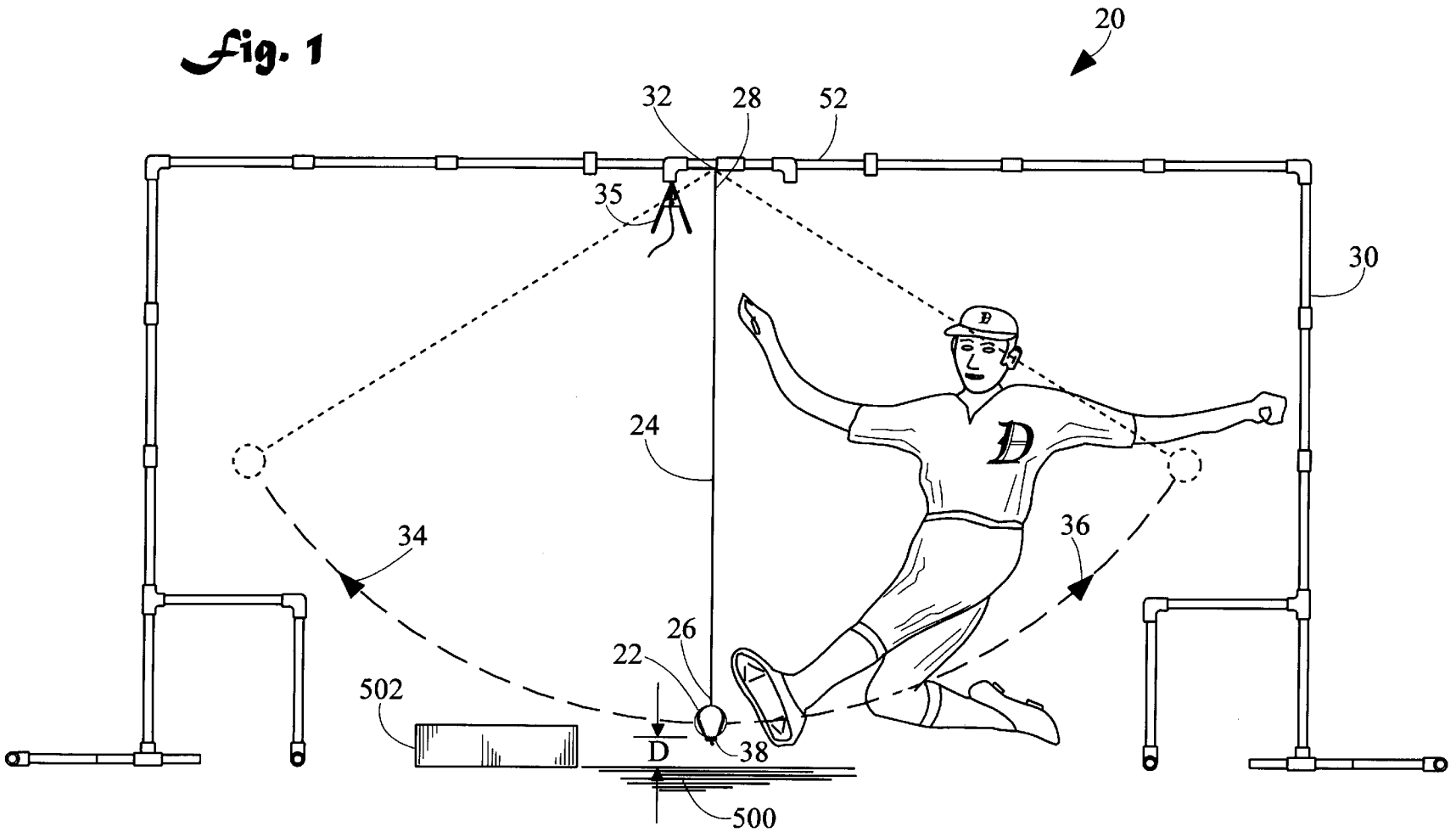
FIG. 1 is a side elevation view of an apparatus for practicing sliding into a baseball base in accordance with the present invention.
Figure 2:
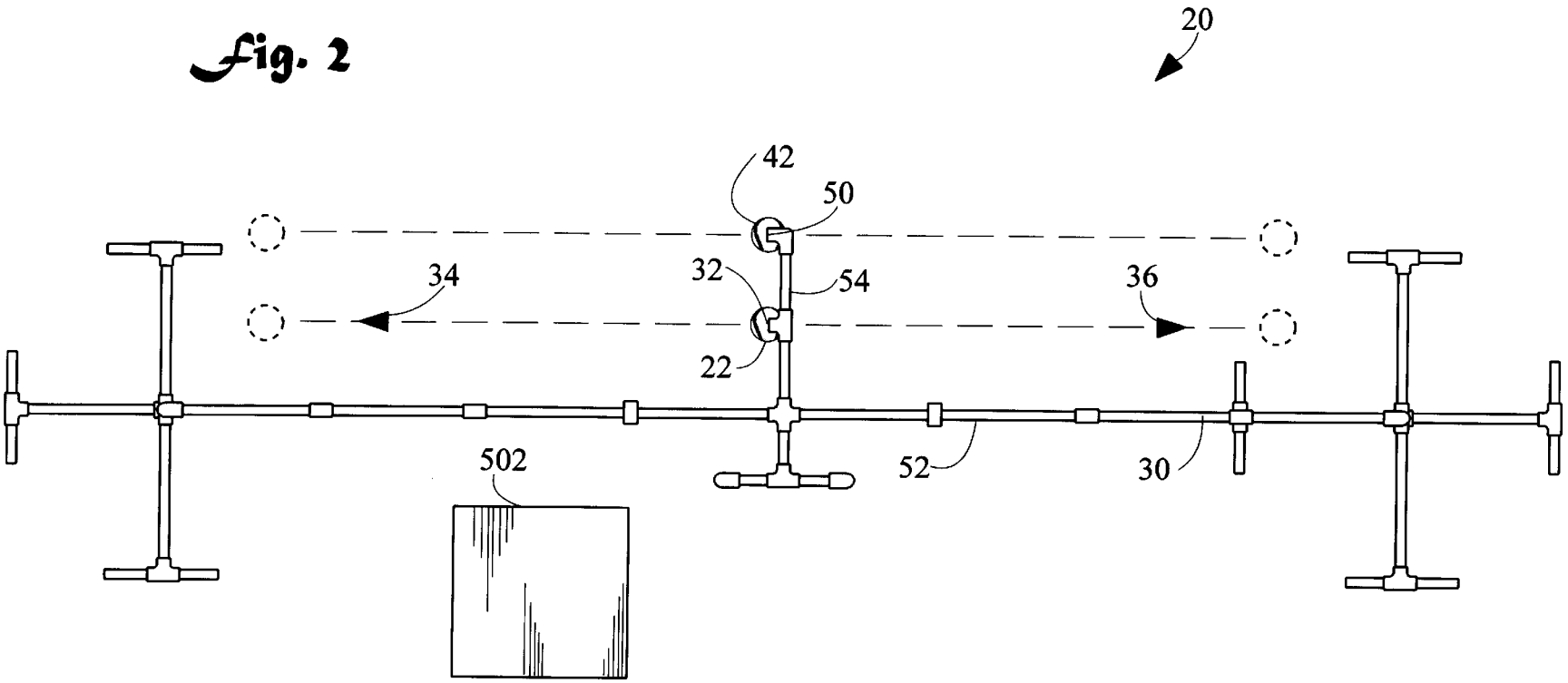
FIG. 2 is a top plan view of the apparatus.
Figure 3:
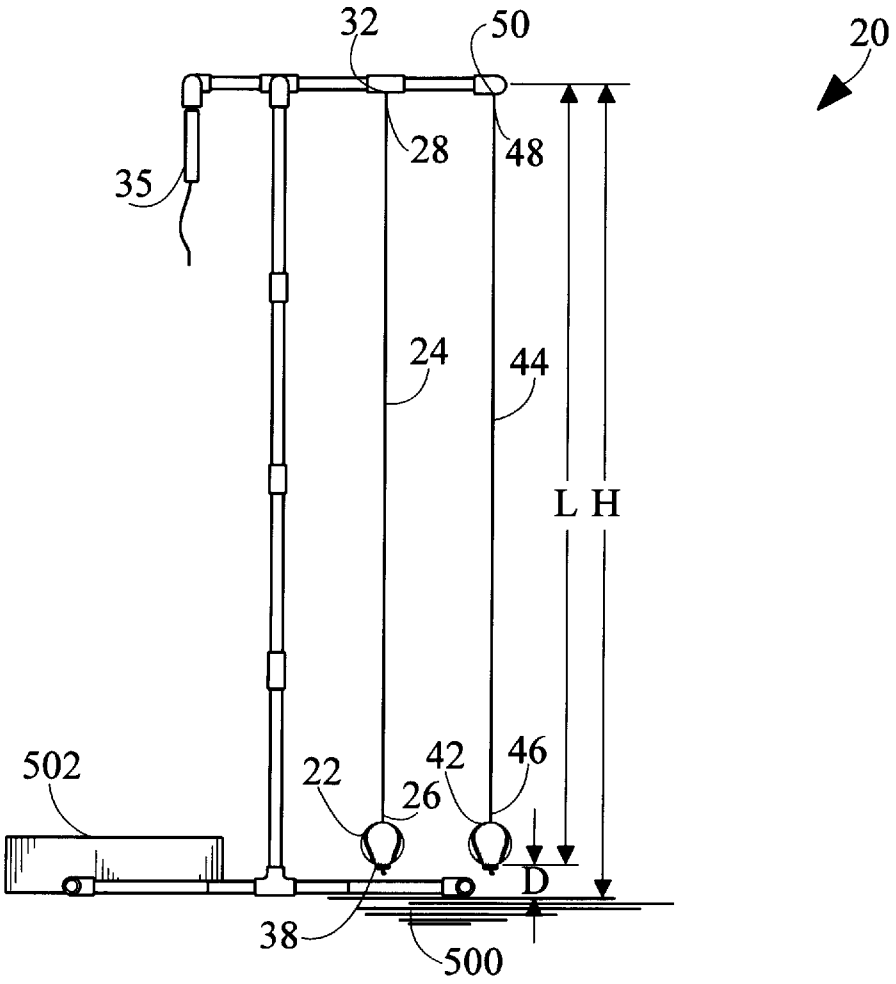
FIG. 3 is an end elevation view of the apparatus; and, FIG. 4 is a side elevation view of the apparatus showing two baseballs.

Referring initially to FIGS. 1, 2, and 3, there are illustrated side elevation, top plan, and end elevation views respectively of an apparatus for practicing sliding into a baseball base in accordance with the present invention, generally designated as 20. Apparatus 20 includes a first baseball 22 and a first tether 24 having a first end 26, an opposite end 28, and a length L. The tether 24 can be made of string, rope, chain, etc. In a preferred embodiment tether 24 is made of nylon chord. First end 26 is connected to first baseball 22. The connection can be made by simply drilling an equatorial hole in baseball 22, inserting tether 24 through the hole, and securing tether 24 on the opposite side of the hole. A support structure 30 has a first connection point 32 to which second end 28 of tether 24 is connected, so that first baseball 22 is suspended between approximately one and six inches above the ground. In other words, first connection point 32 has a first height H above the ground 500, and first tether 24 has a first length L which is approximately one to six inches less than first height H. This distance D above the ground 500 approximates the vertical position of a baseball 22 being used by a base player to tag out a sliding player. Baseball 22 can be closer than one inch to the ground 500, however care must be taken so the baseball 22 does not hit the ground 500 when it is swung. Since first baseball 22 is suspended above the ground 500, it can then be selectively swung in pendulum fashion, moving for example in directions 34 and 36 as shown, or in a plurality of other planes of motion. Height H may be selectively adjusted so that the period of motion varies. Since in a preferred embodiment, support structure 30 is fabricated from conventional pipe and pipe fittings, height H may be conveniently adjusted by adding or removing vertical support members to/from support structure 30. The pendulum motion of baseball 22 can also be altered by adding a weight 38, such as metal washers, to baseball 22. Further, the chord of tether 24 can be threaded through the pipe and pipe fittings and conveniently secured in place by clamp 35. A baseball base 502 is disposed on the ground 500 near suspended first baseball 22. Baseball base 502 should be positioned so that it is on the opposite side of swinging baseball 22 from the practicing player. That is, the player must slide past the swinging baseball 22 to touch baseball base 502.

In the embodiment shown in FIG. 1, only first baseball 22 is utilized. However, in the embodiments shown in FIGS. 2 and 3, a second baseball 42 is also included. This increases the difficulty of reaching baseball base 502 due to the presence of two swinging baseballs. It would of course be possible to add third, fourth, etc. swinging baseballs as well. Second baseball 42 is connected to second tether 44 at first end 46. Opposite end 48 of second tether 44 is connected to second connection point 50 of support structure 30. Second baseball 42 is also suspended between approximately one and six inches above the ground. In other words, second connection point 50 has a second height H above the ground 500, and second tether 44 has a second length L which is approximately one to six inches less than second height H. In the preferred embodiment shown, second tether 44 has the same length L as first tether 24, and second connection point 50 is the same height above the ground 500 as first connection point 32. However it may readily be appreciated that the length of the first 24 and second 44 tethers could be of different lengths, resulting in different periods of pendulum motion.

Referring now to FIG. 2, support structure 30 has a substantially horizontal longitudinal overhead member 52. A traverse member 54 is perpendicularly connected to overhead member 52. First 32 and second 50 connection points are spaced along traverse member 54. By spacing the first 32 and second 50 connection points, baseballs 22 and 42 can swing in two parallel planes, each parallel to overhead member 52, without the possibility of the two baseballs colliding.

In terms of use, first end 26 of first tether 24 is connected to first baseball 22. Second end 28 of first tether 24 is then connected to first connection point 32 so that first baseball 22 is suspended between approximately one and six inches above the ground 500. A baseball base 502 is then dispositioned on the ground 500 near suspended first baseball 22. Baseball 22 is then swung in pendulum fashion, and a player attempts to slide and touch baseball base 502 without being hit by swinging first baseball 22. In another embodiment, second baseball 42 is also swung in pendulum fashion simultaneously with first baseball 22.

Figure 4:
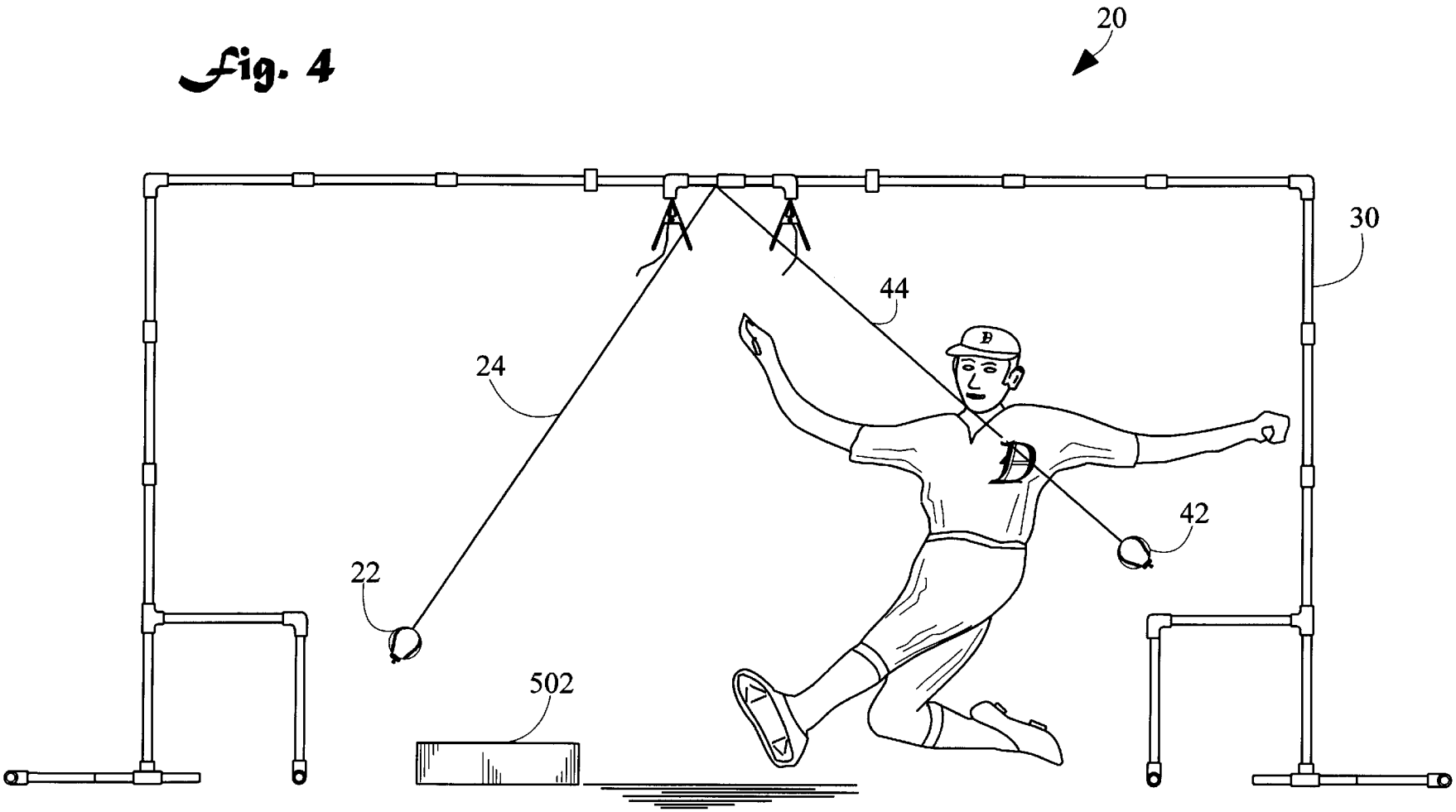

FIG. 4 illustrates a player sliding into baseball base 502 with both first baseball 22 and second baseball 42 swinging in pendulum fashion.

The preferred embodiments of the invention described herein are exemplary and numerous modifications, dimensional variations, and rearrangements can be readily envisioned to achieve an equivalent result, all of which are intended to be embraced within the scope of the appended claims.

I claim:

1. An apparatus for practicing sliding into a baseball base, comprising:

a baseball;

a tether having a first end and an opposite second end;

a support structure having a connection point;

said end of said first tether connected to said baseball; and, said second end of said tether connected to said first connection point so that said first baseball is suspended between approximately one and six inches above.

2. An apparatus according to claim 1, wherein said baseball can be selectively swung in pendulum fashion.

3. An apparatus according to claim 1, wherein said support structure is fabricated from pipe and fittings.

4. An apparatus according to claim 1, further including:

said connection point having a height above said support surface;

said height being selectively adjustable; and, said tether having a length approximately one to six inches less than said height or said connection point.

5. An apparatus according to claim 1, further including a weight attached to said baseball.

6. An apparatus according to claim 1. further including:

a further baseball;

a further tether having a first end and an opposite second end;

said support structure having a further connection point;

said first end of said further tether connected to said second baseball; and, said second end of said further tether connected to said second connection point so that said further baseball is suspended between approximately one and six inches above the ground.

7. An apparatus according to claim 6, further including:

said support structure having a substantially horizontal longitudinal overhead member;

a traverse member perpendicularly connected to said overhead member; and, said connection point and further connection, points being space along said traverse member.

8. An apparatus according to claim 6, wherein said further baseball can be selectively swung in pendulum fashion.

9. An apparatus according to claim 6, wherein:

said connection point and said further connection have a first height above said support surface;

said points being selectively adjustable.

10. An apparatus according to claim 6, further including the baseball base disposed on the ground about said baseball and further baseballs.

11. A method for practicing sliding into a baseball base, comprising the steps of:

providing an apparatus comprising a baseball, a tether having a end and an opposite second end, a support structure having a connection point, and said end of said tether connected to said baseball;

connecting said second end of said tether to said connection point so that said baseball is suspended between approximately one and six inches above the ground;

positioning a baseball base on a support surface below said suspended baseball;

swinging said baseball in pendulum fashion; and, a player attempting to slide and touch the baseball base without being hit by said swinging first baseball.

12. The method according to claim 13, further including the steps of:

providing a further baseball, a second tether having a first end and an opposite second end, said support structure having a further connection point, and said first end of said further tether connected to said second baseball;

connecting said further end of said second tether to said further connection point so that said further baseball is suspended between approximately one and six inches above the ground; and, swinging said second baseball in pendulum fashion simultaneously with said step of swinging said first baseball.

* * * * *